US011738431B2

(12) United States Patent
Chien et al.

(10) Patent No.: US 11,738,431 B2
(45) Date of Patent: Aug. 29, 2023

(54) RETAINING DEVICE FOR USE WITH A NAIL GUN

(71) Applicant: BASSO INDUSTRY CORP., Taichung (TW)

(72) Inventors: Chia-Yu Chien, Taichung (TW); Ching-Han Chang, Taichung (TW); Tsu-Yu Cho, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 17/457,745

(22) Filed: Dec. 6, 2021

(65) Prior Publication Data

US 2022/0176531 A1 Jun. 9, 2022

(30) Foreign Application Priority Data

Dec. 8, 2020 (TW) ..... 109143243

(51) Int. Cl.
*B25C 1/06* (2006.01)

(52) U.S. Cl.
CPC ..... *B25C 1/06* (2013.01)

(58) Field of Classification Search
CPC ..... B25C 1/06
See application file for complete search history.

(56) References Cited

U.S. PATENT DOCUMENTS

2012/0286014 A1* 11/2012 Pedicini ..... B25C 1/04 227/4
2014/0076952 A1* 3/2014 Garber ..... B25C 1/06 227/129
2020/0246952 A1 8/2020 Chien

FOREIGN PATENT DOCUMENTS

EP 2711135 3/2014
JP 2020082302 A 6/2020

OTHER PUBLICATIONS

Search Report issued in corresponding EP Application 21212768.2, dated May 11, 2022, 8 pages.

* cited by examiner

*Primary Examiner* — Thomas M Wittenschlaeger
*Assistant Examiner* — Katie L Gerth
(74) *Attorney, Agent, or Firm* — Burris Law, PLLC

(57) ABSTRACT

A retaining device adapted for use with an electric nail gun includes: a swing arm unit adapted to swing relative to a flywheel of the nail gun; an impact unit adapted to swing with the swing arm unit, and being movable between a pre-striking position proximate to the flywheel, and a striking position distal from the flywheel; a retrieving unit configured to bias the impact unit to move to the pre-striking position; and first and second positioning members connected respectively to the swing arm unit and the impact unit, and magnetically attracted to each other to prohibit removal of the impact unit from the pre-striking position when the impact unit is at the pre-striking position.

6 Claims, 6 Drawing Sheets

RETAINING DEVICE FOR USE WITH A NAIL GUN

CROSS-REFERENCE TO RELATED APPLICATION

This application claims priority of Taiwanese Patent Application No. 109143243, filed on Dec. 8, 2020.

FIELD

The disclosure relates to an electric nail gun, and more particularly to a retaining device for use with an electric nail gun having a flywheel.

BACKGROUND

A conventional electric nail gun disclosed in Japanese Patent Publication No. 2020082302 includes a flywheel that is rotatable by electric power, a driver that is configured to be driven by rotation of the flywheel to strike a nail, a returning mechanism that moves the driver to its original position after the striking, and a stopping mechanism that restricts movement of the driver after the driver returns to the original position. During a nail-striking process, the stopping member is disengaged from the driver, so that the driver can be pushed by a pushing member to contact a pressure roller. The pressure roller then pushes the driver to contact the flywheel to perform the striking operation.

When the nail-striking process is completed and the driver is moved to its original position by the returning mechanism, movement of the driver is restricted by the stopping mechanism such that the driver is prevented from being accidentally driven to strike the nail. However, the stopping mechanism of the conventional electric nail gun has a rather complex configuration, which makes it difficult for installation and maintenance.

SUMMARY

Therefore, the object of the disclosure is to provide a retaining device for use with an electric nail gun that has a simpler structure for installation and maintenance.

According to the disclosure, a retaining device is adapted for use with a nail gun. The nail gun includes a frame, and a flywheel that is rotatably mounted to the frame. The retaining device includes a swing arm unit, an impact unit, a retrieving unit and a positioning unit.

The swing arm unit is adapted to be pivoted to the frame, and is adapted to swing relative to the frame between a proximate position, where the swing arm unit is proximate to the flywheel, and a distal position, where the swing arm unit is distal from the flywheel. The impact unit is movably connected to the swing arm unit, is adapted to swing with the swing arm unit relative to the frame, and is movable in a striking direction, and a retrieving direction opposite to the striking direction between a pre-striking position, where the impact unit is proximate to the flywheel, and a striking position, where the impact unit is distal from the flywheel. The retrieving unit is connected between the impact unit and the swing arm unit, and is configured to bias the impact unit to move in the retrieving direction to the pre-striking position. The positioning unit includes at least one first positioning member that is fixedly connected to the swing arm unit, and at least one second positioning member that is fixedly connected to the impact unit.

When the impact unit is at the pre-striking position and when the swing arm unit is at the distal position, the at least one second positioning member is proximate to the at least one first positioning member such that the magnetic attraction therebetween prohibits removal of the impact unit from the pre-striking position. When the impact unit is at the pre-striking position and when the swing arm unit swings toward the proximate position, the impact unit is brought into contact with the flywheel and then driven by rotation of the flywheel to overcome the magnetic attraction between the at least one first positioning member and the at least one second positioning member, so as to move from the pre-striking position to the striking position.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
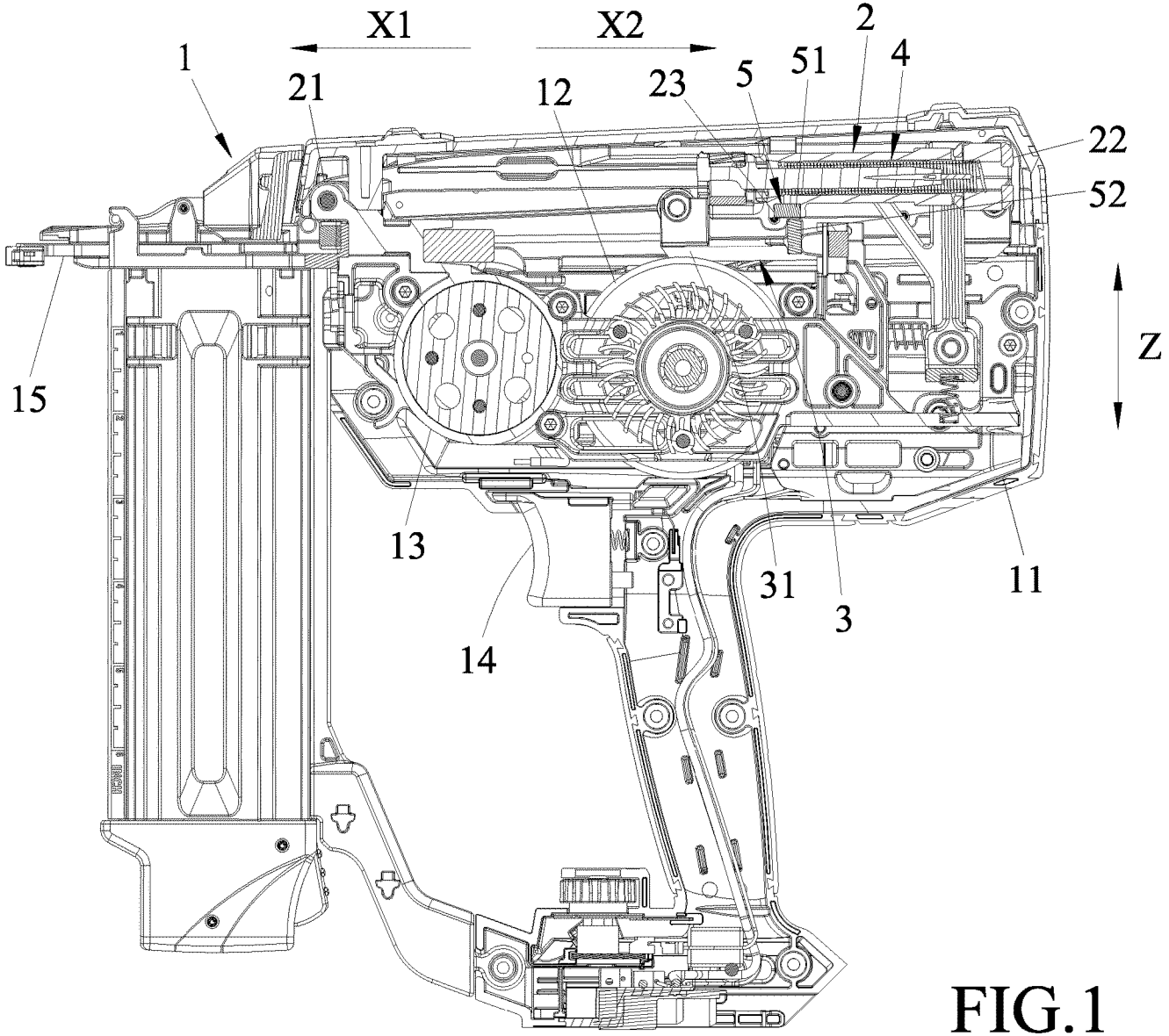
FIG. 1 is a schematic side view of an embodiment of a retaining device according to the disclosure being mounted in a nail gun, illustrating a swing arm unit of the embodiment being at a distal position and an impact unit being at a pre-striking position.
Figure 2:
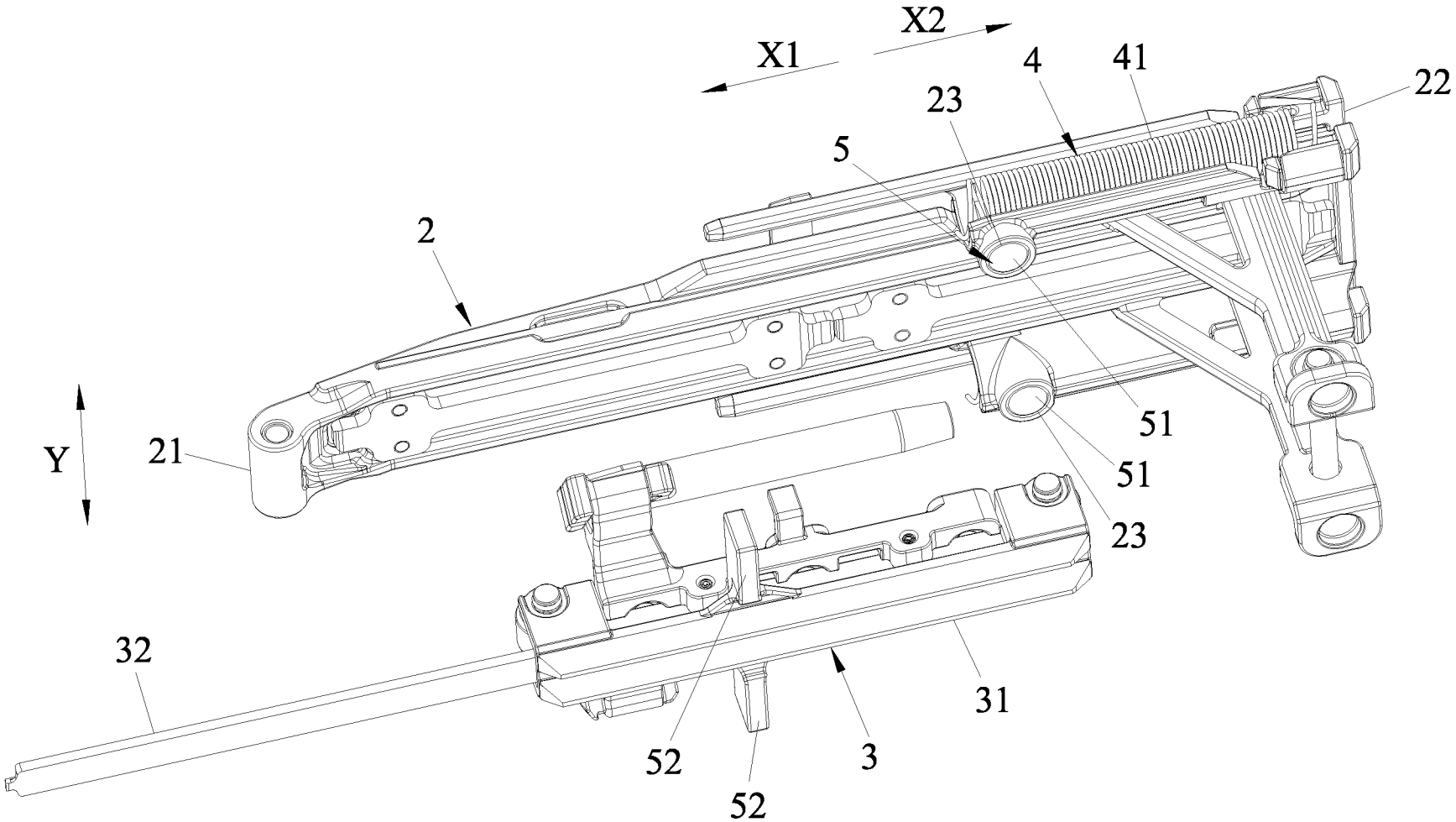
FIG. 2 is a fragmentary and partially exploded perspective view of the nail gun and the embodiment.
Figure 3:
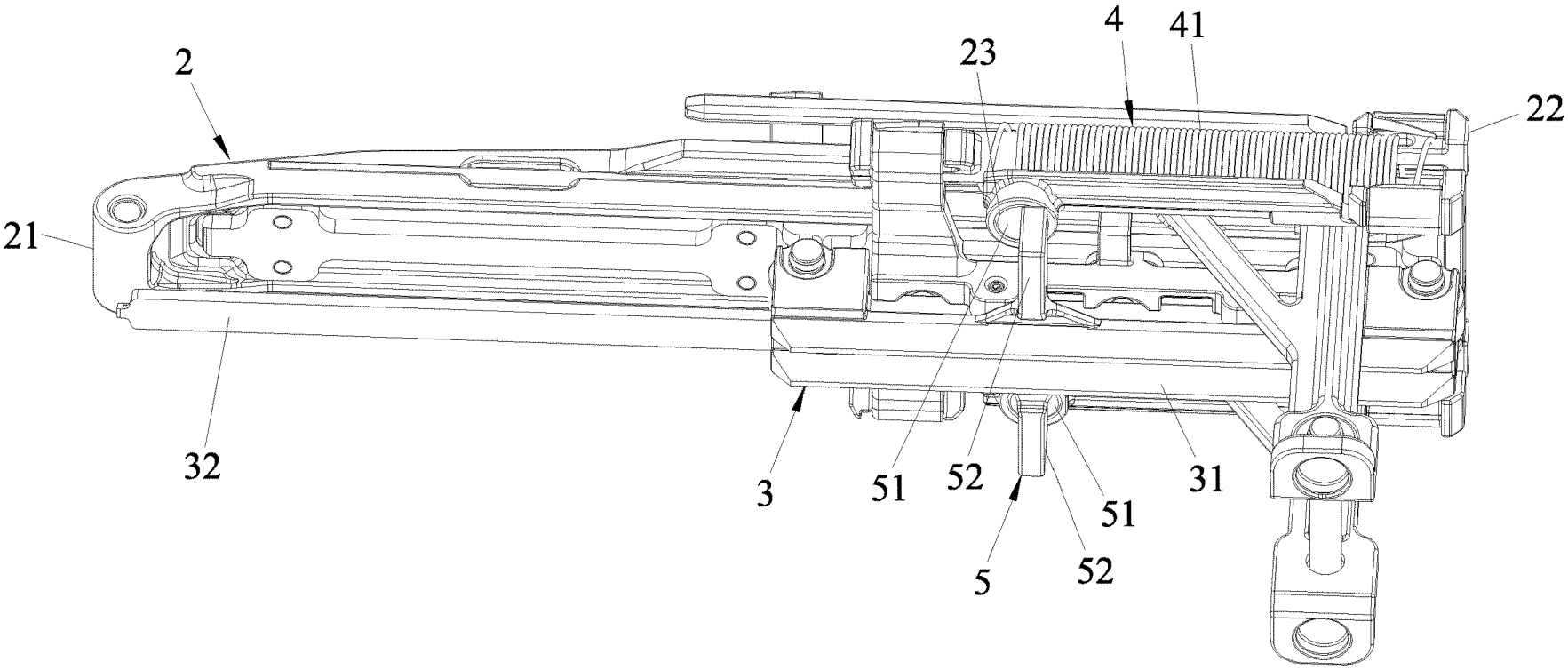
FIG. 3 is a fragmentary perspective view of the nail gun and the embodiment, illustrating the impact unit being at a pre-striking position.

Referring to FIGS. 1, 2 and 3, an embodiment of a retaining device according to the disclosure is adapted for use in a electric nail gun 1. The nail gun 1 includes a frame 11, a flywheel 12 that is rotatably mounted to the frame 11, a motor unit 13 that drives the flywheel 12 to rotate by electric power, and a trigger unit 14 and a safety unit 15 that are movably installed on the frame 11 for manual operation. The trigger unit 14 and the safety unit 15 are configured to determine whether the motor unit 13 is activated and whether to perform a nail-striking action. The retaining device includes a swing arm unit 2, an impact unit 3, a retrieving unit 4, and a positioning member 5.

The swing arm unit 2 extends along a striking direction (X1) and is adapted to be spaced apart from the flywheel 12 along a swinging direction (Z) that is transverse to the striking direction (X1). The swing arm unit 2 includes a pivot portion 21 that is adapted to be pivoted to the frame 11, a swinging portion 22 that is opposite to the pivot portion 21, and two recessed portions 23 that are adapted to be open toward the frame (11), and that are spaced apart from each other along a transverse direction (Y) being transverse to the striking direction (X1) and the swinging direction (Z). In the present embodiment, the striking direction (X1), the swinging direction (Z) and the transverse direction (Y) are substantially perpendicular to one another.

The swing arm unit 2 is adapted to be operated by the trigger unit 14 to swing along the swinging direction (Z) relative to the frame 11 between a distal position (see FIG. 1), where the swinging portion 22 is distal from the flywheel 12, and a proximate position (see FIGS. 4 to 6), where the swinging portion 22 is proximate to the flywheel 12.

The impact unit 3 is movably connected to the swing arm unit 2, and is adapted to swing with the swing arm unit 2 relative to the frame 11. The impact unit 3 includes an impact member 31 that is movably connected to the swing arm unit 2 and that is disposed between the recessed portions 23, and a striking rod 32 that is co-movably connected to the impact member 31 and that is adapted for striking a nail (not shown).

The impact unit 3 is movable in the striking direction (X1) and a retrieving direction (X2) opposite to the striking direction (X1) between a pre-striking position (see FIG. 1), where the impact member 31 of the impact unit 3 is proximate to the swinging portion 22 of the swing arm unit 2 and is proximate to the flywheel 12, and a striking position (see FIG. 6), where the impact member 31 is proximate to the pivot portion 21 of the swing arm unit 2 and is distal from the flywheel 12. When the impact unit 3 is at the pre-striking position and when the swing arm unit 2 swings from the distal position to the proximate position, the impact member 31 of the impact unit 3 is brought into contact with the flywheel 12 so as to be driven by rotation of the flywheel 12 to move toward the striking position.

The retrieving unit 4 includes two resilient members 41 (only one is shown) that are connected between the swing arm unit 2 and the impact member 31 of the impact unit 3, that extend along the striking direction (X1), and that are spaced apart from each other along the transverse direction (Y). The resilient members 41 are configured to bias the impact unit 3 to move in the retrieving direction (X2) to the pre-striking position. It should be noted that the number of the resilient members 41 is not limited to two. In variations of the embodiment, the number of the resilient member 41 may be one or more than two.

The positioning unit 5 includes two first positioning members 51 and two second positioning members 52. The first positioning members 51 are fixedly connected to the swing arm unit 2, are spaced apart from each other along the transverse direction (Y), and are mounted in the recessed portions 23 of the swing arm unit 2, respectively. The second positioning members 52 are fixed respectively to opposite sides of the impact unit 3 which are opposite along the transverse direction (Y), and extend away from each other along the transverse direction (Y). When the impact unit 3 is at the pre-striking position, each of the second positioning members 52 is registered with and attracted to a respective one of the first positioning members 51 along the swinging direction (Z).

In the present embodiment, each of the first positioning members 51 is a magnet, and each of the second positioning members 52 is molded as one piece with the impact member 31 and is made of a ferromagnetic material (e.g., iron). However, it should be noted that the second positioning members 52 are not limited to be made of a ferromagnetic material. In variations of the embodiment, the second positioning members 52 may be magnets that are arranged in a manner such that they are attracted to the first positioning members 51 when the impact unit 3 is at the pre-striking position. It should also be noted that the number of each of the first and second positioning members 51, 52 is not limited to two. In variations of the embodiment, the number of each of the first and second positioning members 51, 52 may be one or more than two.

Referring again to FIG. 1, prior to an operation of the nail gun 1, the swing arm unit 2 is at the distal position (i.e., the swinging portion 22 of the swing arm unit 2 is distal from the flywheel 12) and the impact unit 3 is at the pre-striking position, such that the impact member 31 is proximate to and spaced apart from the flywheel 12. At this time, each of the second positioning members 52 is proximate to the respective one of the first positioning members 51 such that the magnetic attraction therebetween prohibits removal of the impact unit 3 from the pre-striking position.

Figure 4:
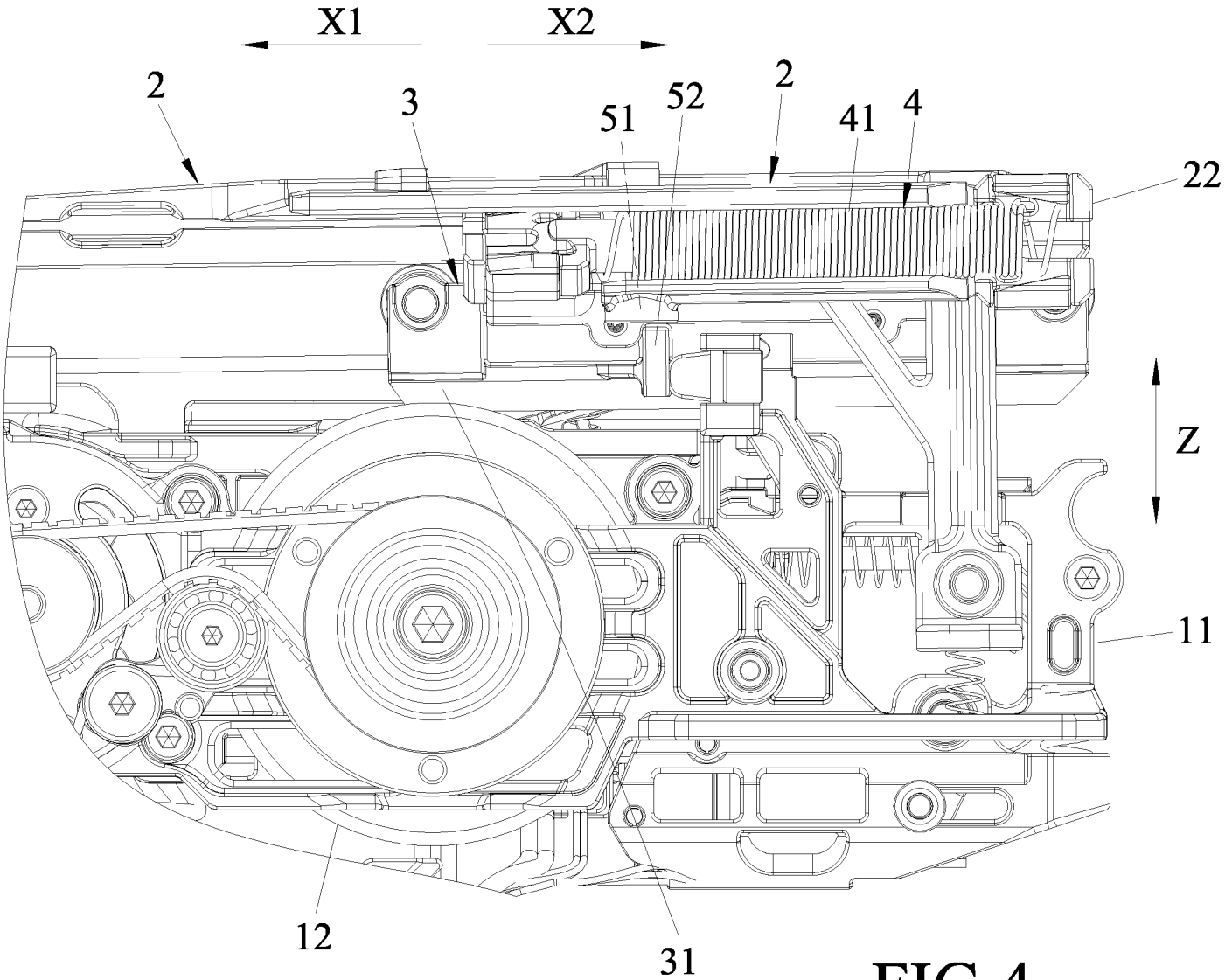
FIG. 4 is a fragmentary side view of the nail gun and the embodiment, illustrating the swing arm unit being at a proximate position.
Figure 5:
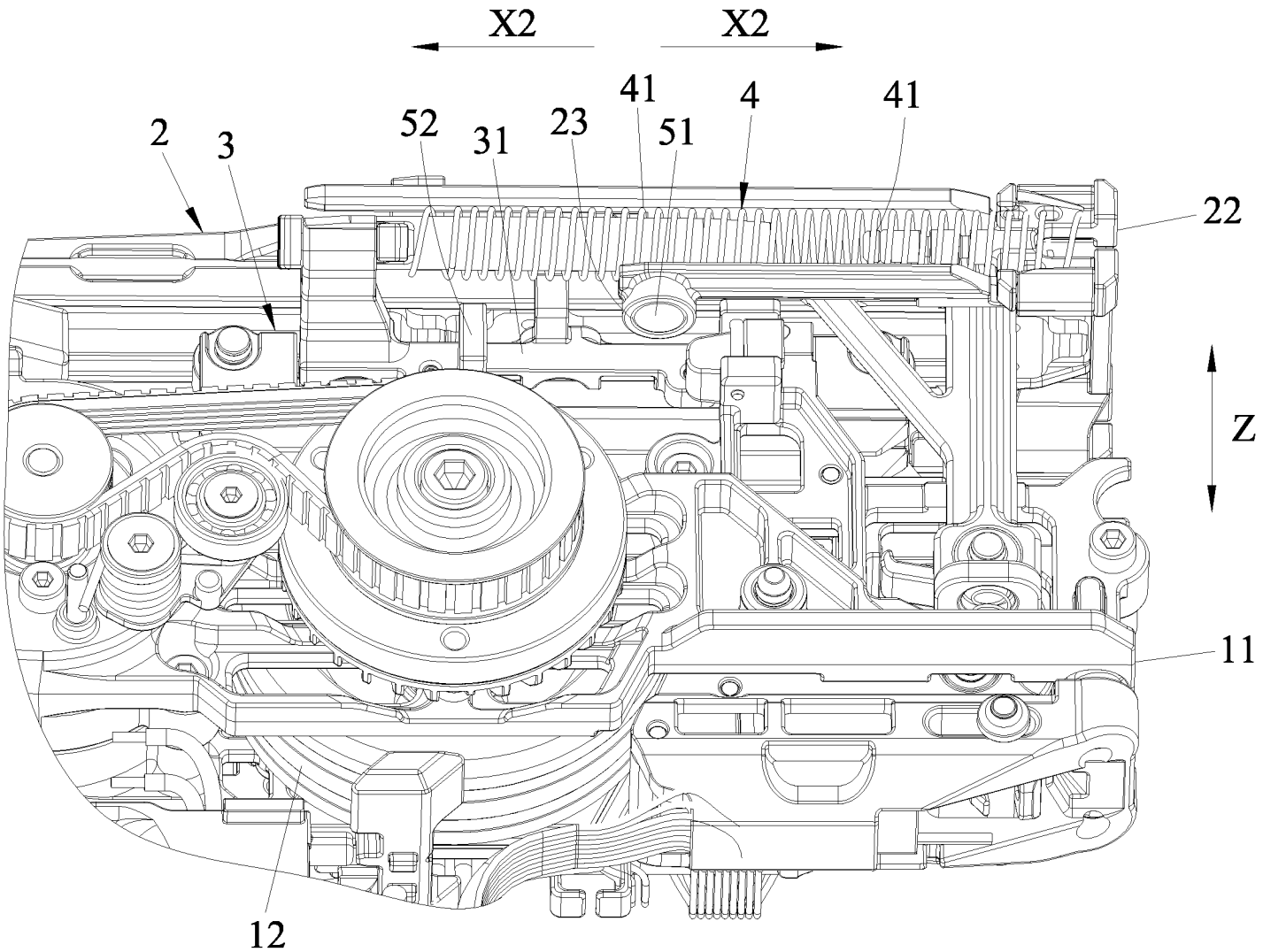
FIG. 5 is a fragmentary perspective view of the nail gun and the embodiment, illustrating the impact unit being removed from the pre-striking position.
Figure 6:
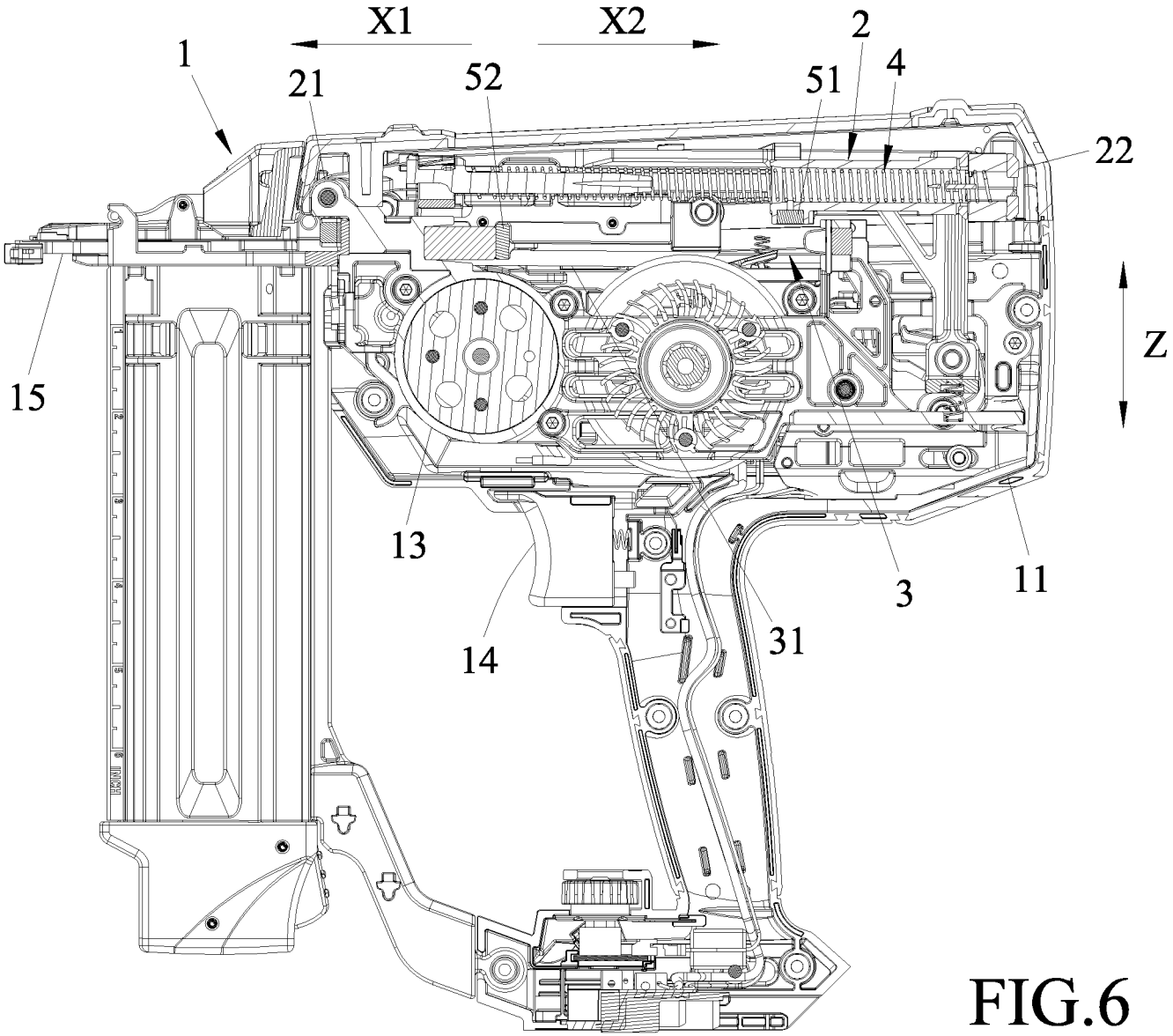
FIG. 6 is a schematic side view similar to FIG. 1, but illustrating the impact unit being at a striking position.

Referring to FIG. 4 and FIG. 5, during the operation, when the flywheel 12 starts to rotate to a predetermined speed, a user may operate the trigger unit 14 to enter a single-striking mode, or operate both the trigger unit 14 and the safety unit 15 in order to enter a sequential-striking mode. Then, the swing arm unit 2 is driven to swing toward the flywheel 12 to the proximate position and bring the impact member 31 at the pre-striking position toward the flywheel 12. Once the impact member 31 is brought into contact with the flywheel 12, the impact unit 3 is urged by the rotation of the flywheel 12 to overcome the magnetic attraction between the first positioning members 51 and the second positioning members 52, so as to move in the striking direction (X1) from the pre-striking position toward the striking position (see FIG. 6). After the striking rod 32 of the impact unit 3 strikes the nail (not shown), the swing arm unit 2 returns from the proximate position to the distal position (see FIG. 1), and the impact unit 3 is subjected to the biasing force of the resilient members 41 to move in the retrieving direction (X2) from the striking position toward the pre-striking position.

Specifically, referring to FIG. 3, when the impact unit 3 is driven by the resilient member 41 to move toward the pre-striking position, each of the second positioning members 52 connected to the impact member 31 becomes proximate to and attracted to the respective one of the first positioning members 51 again. As a result, the magnetic attraction between the first and second positioning members 51, 52 provides a positioning effect that prohibits potential movement of the impact unit 3 caused by oscillatory motion of the resilient members 41, and thus prevents the impact unit 3 from accidentally striking the nail. It should be noted that, since the impact unit 3 is configured to swing with the swing arm unit 2, the magnetic attraction between the first and second positioning members 51, 52 is not affected by the movement of the swing arm unit 2 between the distal position the proximate position.

In sum, the present embodiment of the retaining device for use in the nail gun has benefits as follows. By virtue of the positioning effect provided by the first and second positioning members 51, 52, the impact unit 3 is prevented from accidentally striking the nail after returning from the striking position to the pre-striking position. In addition, compared with the prior art, the retaining device of the present disclosure is able to provide the same function with a simpler structure, which is easier for installation and maintenance.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A retaining device adapted for use with a nail gun, the nail gun including a frame, and a flywheel that is rotatably mounted to the frame, said retaining device comprising:

a swing arm unit that is adapted to be pivoted to the frame, and that is adapted to swing relative to the frame between a proximate position, where said swing arm unit is proximate to said flywheel, and a distal position, where said swing arm unit is distal from the flywheel;

an impact unit that is movably connected to said swing arm unit, that is adapted to swing with said swing arm unit relative to the frame, and that is movable in a striking direction, and a retrieving direction opposite to the striking direction between a pre-striking position, where said impact unit is proximate to said flywheel, and a striking position, where said impact unit is distal from said flywheel;

a retrieving unit that is connected between said impact unit and said swing arm unit, and that is configured to bias said impact unit to move in the retrieving direction to the pre-striking position; and a positioning unit that includes at least one first positioning member fixedly connected to said swing arm unit, and at least one second positioning member fixedly connected to said impact unit;

wherein when said impact unit is at the pre-striking position and when said swing arm unit is at the distal position, said at least one second positioning member is proximate to said at least one first positioning member such that the magnetic attraction therebetween prohibits removal of said impact unit from the pre-striking position;

wherein when said impact unit is at the pre-striking position and when said swing arm unit swings toward the proximate position, said impact unit is brought into contact with the flywheel and then driven by rotation of the flywheel to overcome the magnetic attraction between said at least one first positioning member and said at least one second positioning member, so as to move from the pre-striking position to the striking position;

wherein said swing arm unit is adapted to swing in a swinging direction relative to the frame, the swinging direction being transverse to the striking direction, said at least one second positioning member being registered with said at least one first positioning member along the swinging direction when said impact unit is at the pre-striking position; and wherein said swing arm unit has two recessed portions that are adapted to be open toward the frame, said positioning unit includes two of said first positioning members, said first positioning members being mounted in said recessed portions of said swing arm unit, respectively.

2. The retaining device as claimed in claim 1, wherein said positioning unit includes two of said second positioning members, each of said second positioning members being registered with and attracted to a respective one of said first positioning members when said impact unit is at the pre-striking position.

3. The retaining device as claimed in claim 2, wherein said first positioning members are spaced apart from each other along a transverse direction that is substantially perpendicular to the striking direction, said second positioning members being fixed respectively to opposite sides of said impact unit which are opposite along the transverse direction and extending away from each other along the transverse direction.

4. The retaining device as claimed in claim 1, wherein said at least one first positioning member is a magnet, and said at least one second positioning member is made of one of a ferromagnetic material and a magnet.

5. The retaining device as claimed in claim 1, wherein said retrieving unit includes at least one resilient member.

6. The retaining device as claimed in claim 5, wherein said retrieving unit includes two of said resilient members, said resilient members extending along the striking direction and being spaced apart from each other along a transverse direction, the transverse direction being substantially perpendicular to the striking direction.

* * * * *